US010004964B2

(12) United States Patent
Chu

(10) Patent No.: US 10,004,964 B2
(45) Date of Patent: Jun. 26, 2018

(54) SUSPENSION BASKETBALL BOARD

(71) Applicant: Jiao Hsiung Industry Corp., New Taipei (TW)

(72) Inventor: Keng-Fong Chu, New Taipei (TW)

(73) Assignee: Jiao Hsiung Industry Corp., New Taipei (TW)

( * ) Notice: Subject to any disclaimer, the term of this patent is extended or adjusted under 35 U.S.C. 154(b) by 0 days. days.

(21) Appl. No.: 15/586,487

(22) Filed: May 4, 2017

(65) Prior Publication Data

US 2017/0232316 A1 Aug. 17, 2017

Related U.S. Application Data

(63) Continuation-in-part of application No. 13/957,481, filed on Aug. 2, 2013, now abandoned.

(30) Foreign Application Priority Data

Dec. 28, 2012 (TW) ..... 101225379 U

(51) Int. Cl.
*A63B 63/08* (2006.01)

(52) U.S. Cl.
CPC ..... *A63B 63/083* (2013.01)

(58) Field of Classification Search
CPC ..... A63B 63/083; Y10T 403/32008; Y10T 403/32024; Y10T 403/32041; Y10T 403/32049; A47G 25/0614
USPC ..... 248/214, 276.1, 278.1, 285.1, 290.1, 248/294.1, 301, 304, 305, 308, 339–341; 403/53
See application file for complete search history.

(56) References Cited

U.S. PATENT DOCUMENTS

| | | | |
|---|---|---|---|
| 1,544,016 | A | 6/1925 | Lyman |
| 2,534,067 | A | 12/1950 | Rubin |
| 5,827,136 | A | 10/1998 | Halter et al. |
| 6,345,796 | B1 | 2/2002 | Neuman |
| 6,481,680 | B2 | 11/2002 | Neuman |
| 7,887,017 | B2 | 2/2011 | Moran |
| 8,371,965 | B2 | 2/2013 | Quinn |
| 8,777,170 | B2 | 7/2014 | Gilbert |
| D720,612 | S | 1/2015 | Gilbert |

FOREIGN PATENT DOCUMENTS

| | | | | |
|---|---|---|---|---|
| DE | 202005015705 U1 | | 3/2007 | |
| GB | 2464530 A | * | 4/2010 | ..... A47G 25/0614 |

* cited by examiner

*Primary Examiner* — Melba Bumgarner
*Assistant Examiner* — Laura L Davison
(74) *Attorney, Agent, or Firm* — Alan D. Kamrath; Kamrath IP Lawfirm, P.A.

(57) ABSTRACT

A suspension basketball board has a backboard, a basketball hoop, and at least one hanging device. Each of the at least one hanging device has a hanger, at least one clamping panel, a mounting hole, a first joint, and a second joint. The at least one clamping panel connects to the hanger and is resilient relative to the hanger. The mounting hole is formed through the top panel of the hanger. The first joint is mounted between the connecting panel and the top panel of the hanger. The second joint is mounted between the top panel and the back panel of the hanger. Accordingly, the suspension basketball board can be horizontally and stably mounted on a door of any thickness.

12 Claims, 18 Drawing Sheets

SUSPENSION BASKETBALL BOARD

CROSS-REFERENCE TO RELATED APPLICATIONS

This application is a continuation-in-part application Ser. No. 13/957,481 filed on Aug. 2, 2013.

BACKGROUND OF THE INVENTION

1. Field of the Invention

The present invention relates to a suspension basketball board, especially to a suspension basketball board that can be horizontally and stably mounted on doors or walls of different thicknesses.

2. Description of the Prior Arts

Basketball has long been a popular sport. A suspension basketball board, which can be hung on a door or a wall, is used for playing basketball in places other than a formal basketball court. Thus, amateur basketball enthusiasts can play basketball and exercise at any indoor space.

With reference to FIG. 18, a conventional suspension basketball board comprises a backboard 50, a basketball hoop 60 and a hanger 70. The basketball hoop 60 is mounted on a front surface of the backboard 50. The hanger 70 is mounted on a top side of a back surface of the backboard 50, and has a connecting panel 71 and a hook part. The connecting panel 71 connects to the backboard 50. The hook part is bent backwardly from the connecting panel 71 and has a top panel 72 and a back panel 73. The suspension basketball board can be hung up by hooking the hanger 70 on the door or the wall. Preferably, a top side of the door or the wall is disposed between the backboard 50 and the hanger 70.

However, a length of the top panel 72 of the conventional hanger 70 is fixed, such that a distance between the back board 50 and the back panel 73 cannot be adjusted. The distance between the back board 50 and the back panel 73 corresponds to a thickness of the door 80 or the wall 80A. Since different doors 80 or walls 80A may have different thicknesses, the distance between the back board 50 and the back panel 73 cannot always correspond to the thickness of the door 80 or the wall 80A. As such, the suspension basketball board may lean forward, and may easily shake or even fall from the door 80 or the wall 80A, thereby affecting the players' shooting practice.

To overcome the shortcomings, the present invention provides a suspension basketball board to mitigate or obviate the aforementioned problems.

SUMMARY OF THE INVENTION

The main objective of the present invention is to provide a suspension basketball board that can be horizontally and stably mounted on doors of different thicknesses.

The suspension basketball board comprises a backboard, a basketball hoop, and at least one hanging device. The basketball hoop is mounted on a front surface of the backboard. The at least one hanging device is mounted on a back surface of the backboard. Each of the at least one hanging device has a hanger, at least one clamping panel, a room, a mounting hole, a first joint, and a second joint.

The hanger is connected to the backboard and includes a connecting panel, a top panel, and a back panel. The connecting panel is connected to the backboard. The connecting panel has an upper sheet, a lower sheet connected with the upper sheet, a connecting part connected between the lower sheet and the upper sheet, a mounting space, and a through hole formed through the upper sheet and the lower sheet. The lower sheet is connected to the backboard. The connecting part of the connecting panel is disposed at a bottom surface of the upper sheet. The mounting space of the connecting panel is formed between the upper sheet, the lower sheet, and the connecting part of the connecting panel. The through hole of the connecting panel is connected to the mounting space of the connecting panel. The top panel has a front side connected to the upper sheet. The back panel is connected to a back side of the top panel. The back panel extends at a spaced interval from the back surface. The back panel has an upper plate connected to the back side of the top panel, a lower plate connected with the upper plate, a connecting part connected between the lower plate and the upper plate, a mounting space, and a through hole formed through the upper plate and the lower plate. The connecting part of the back panel is disposed at a bottom surface of the upper plate. The mounting space of the back panel is formed between the upper plate, the lower plate, and the connecting part of the back panel. The through hole of the back panel is formed through the upper plate and the lower plate and connected to the mounting space of the back panel.

The said at least one clamping panel is connected to the hanger and is resilient relative to the hanger. Each one of the at least one clamping panel has a fixed end connected to the lower plate of the back panel and spaced from the top panel, and a free end spaced from and extending obliquely toward the backboard, and spaced from and extending toward the top panel.

The room is defined between the backboard, the connecting panel, the top panel, and the back panel. The mounting hole is formed through the top panel. The first joint is mounted between the connecting panel and the front side of the top panel. The second joint is mounted between the back side of the top panel and the back panel.

Each of the first joint and the second joint includes a first pivot having a pivot body and a rim protruding transversely out from the pivot body, and a second pivot tightly mounted through the pivot body. The pivot body of the first pivot of the first joint is mounted through the top panel at the front side, and is disposed in the through hole of the connecting panel and the mounting space of the connecting panel. The rim of the first pivot of the first joint abuts the top panel at the front side. The second pivot of the first joint is mounted in the mounting space of the connecting panel and is mounted tightly through the pivot body of the first pivot of the first joint. The pivot body of the first pivot of the second joint is mounted through the top panel at the back side, and is disposed in the through hole of the back panel and the mounting space of the back panel. The rim of the first pivot of the second joint abuts the top panel at the back side. The second pivot of the second joint is mounted in the mounting space and is mounted tightly through the pivot body of the first pivot of the second joint. Each of the at least one clamping panel is selectively disposed in the room.

When the suspension basketball board is in use, the door is clamped between the backboard and the at least one clamping panel. As the at least one clamping panel connects to the hanger and is resilient relative to the hanger, the at least one clamping panel can abut a door of any thickness. Thus, the suspension basketball board can be mounted horizontally and stably on doors of different thicknesses without affecting the user's shooting practice.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
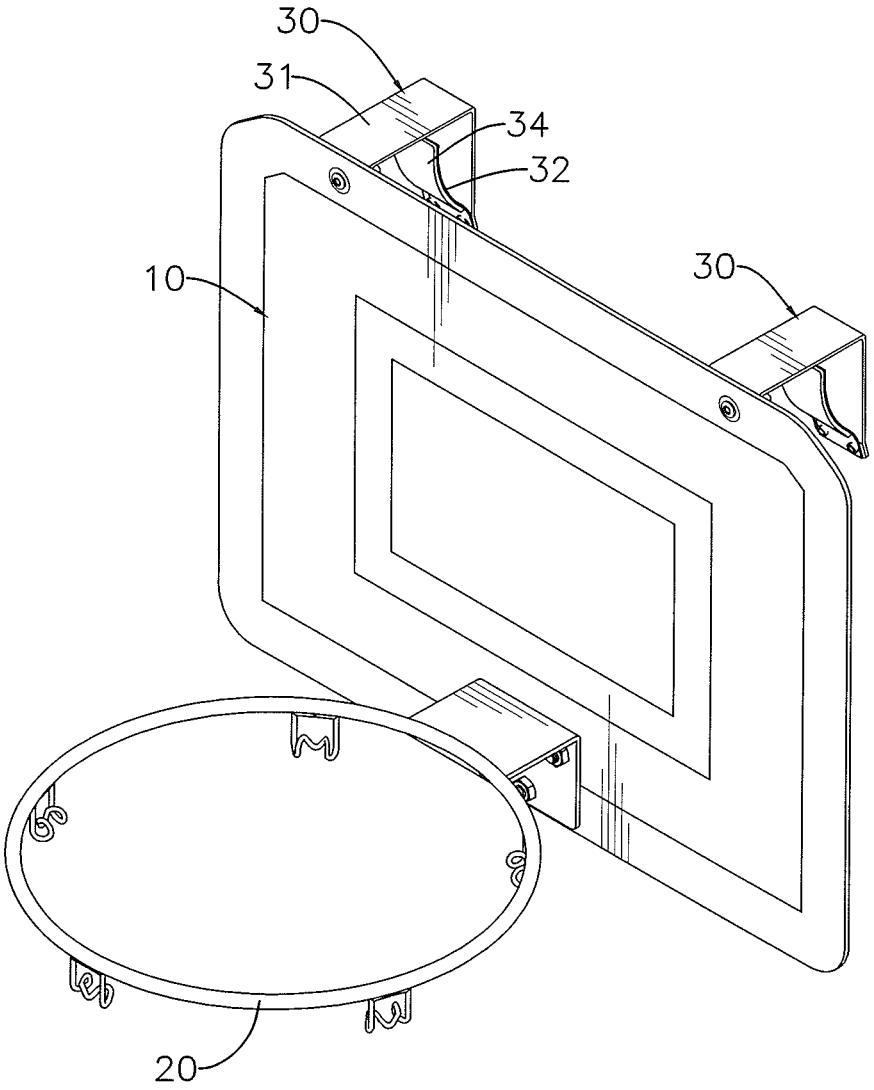
FIG. 1 is a perspective view of a first embodiment of a suspension basketball board in accordance with the present invention.
Figure 2:
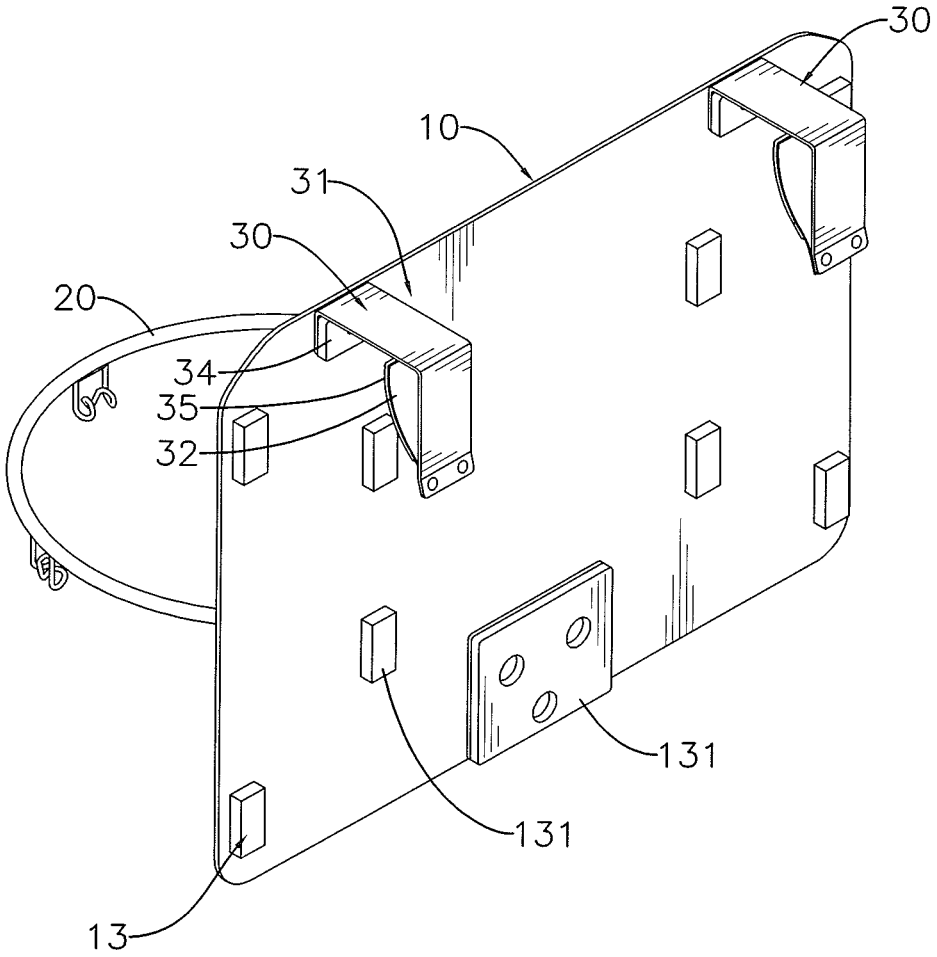
FIG. 2 is another perspective view of the suspension basketball board in FIG. 1.

With reference to FIGS. 1 and 2, a suspension basketball board in accordance with the present invention comprises a backboard 10, a basketball hoop 20 and at least one hanging device 30.

Figure 3:
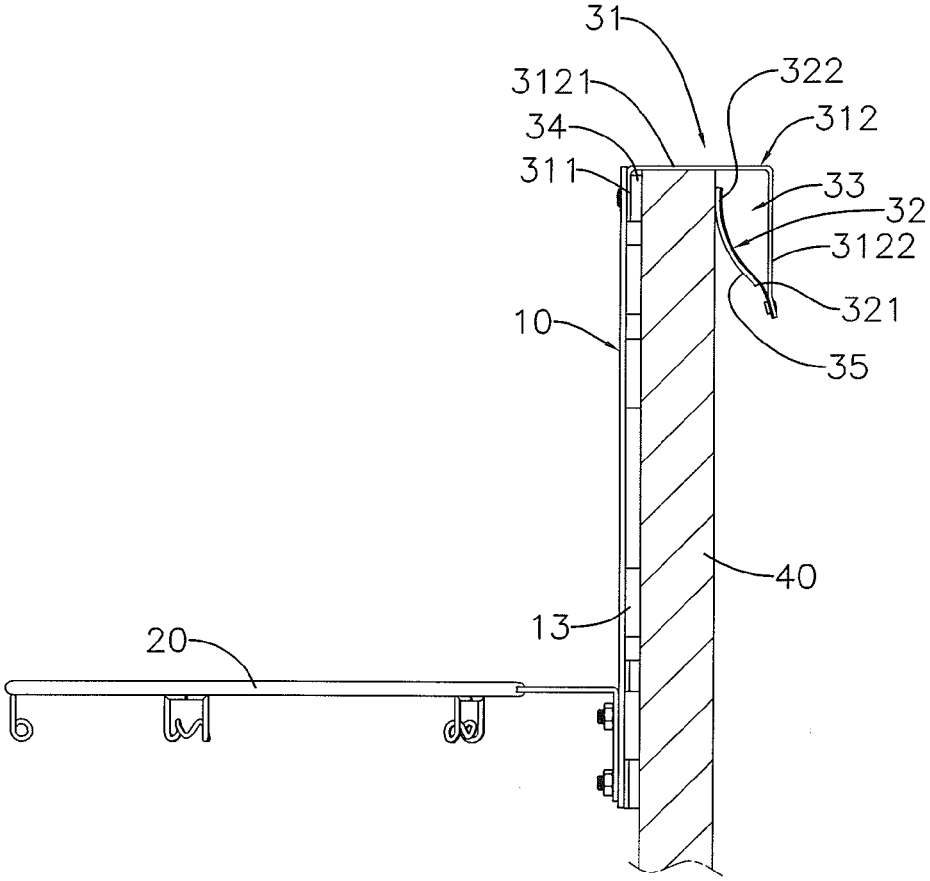
FIG. 3 is a side view of the suspension basketball board in FIG. 1, shown clamping a door.

With reference to FIGS. 1 to 3, the backboard 10 has a front surface and a back surface. In a preferred embodiment, the suspension basketball board further has a backboard cushion assembly 13. The backboard cushion assembly 13 is mounted on the back surface of the backboard 10, and has multiple backboard cushions 131 mounted at intervals on the back surface of the backboard 10.

With reference to FIGS. 1 and 2, the basketball hoop 20 is horizontally mounted on the front surface of the backboard 10.

With reference to FIGS. 1 to 3, the at least one hanging device 30 is horizontally mounted on a top side of the back surface of the backboard 10. Each one of the at least one hanging device 30 has a hanger 31, a room 33 and at least one clamping panel 32. The hanger 31 has a connecting panel 311 and a hook part 312. The connecting panel 311 connects to the backboard 10. The hook part 312 is bent backwardly from the connecting panel 311. The room 33 is defined between the backboard 10 and the hook part 312. Each one of the at least one clamping panel 32 connects to the hanger 31, is resilient relative to the hanger 31, and has a fixed end 321 and a free end 322. The fixed end 321 connects to the hanger 31. The free end 322 extends obliquely toward the backboard 10, and is disposed within the room 33. When an external force is exerted on the at least one clamping panel 32, the free end 322 can abut the hanger 31 with the fixed end 321 as a pivot.

In a preferred embodiment, with reference to FIG. 3, the hook part 312 has a top panel 3121 and a back panel 3122. The top panel 3121 has a front side and a back side. The front side of the top panel 3121 connects to the connecting panel 311. The back panel 3122 connects to the back side of the top panel 3121 and the fixed end 321 of each one of the at least one clamping panel 32. The room 33 is defined between the backboard 10, the connecting panel 311, the top panel 3121 and the back panel 3122.

In a preferred embodiment, with reference to FIGS. 2 and 3, each one of the at least one hanging device 30 further has a first hanging cushion 34 and at least one second hanging cushion 35. The first hanging cushion 34 is mounted on the connecting panel 311 of the hanger 31. Each one of the at least one second hanging cushion 35 is mounted on the corresponding clamping panel 32. The at least one second hanging cushion 35 and the first hanging cushion 34 are disposed opposite each other on two sides of the room 33.

In a first embodiment as shown in FIG. 1, the suspension basketball board has two hanging devices 30, and each hanging device 30 has only one clamping panel 32.

Figure 4:
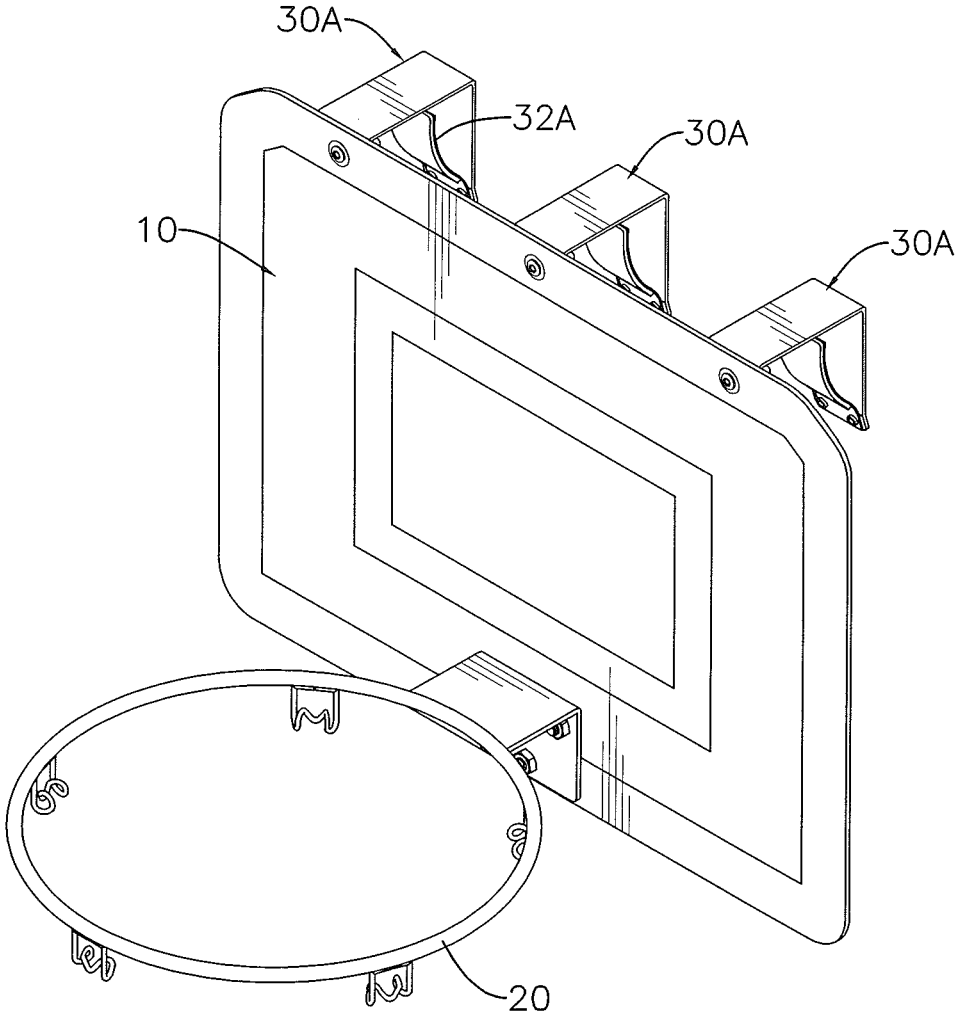
FIG. 4 is a perspective view of a second embodiment of a suspension basketball board in accordance with the present invention.

In a second embodiment as shown in FIG. 4, the suspension basketball board has three hanging devices 30A, and each hanging device 30A has only one clamping panel 32A.

Figure 5:
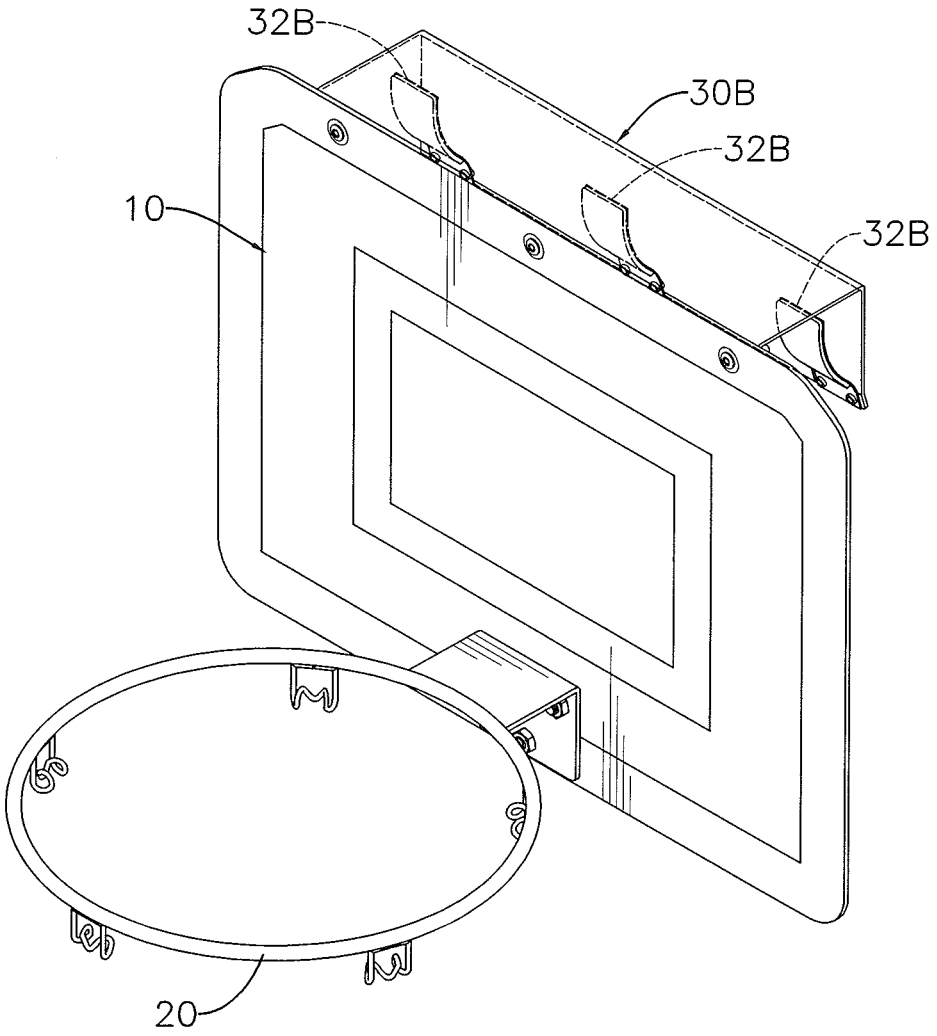
FIG. 5 is a perspective view of a third embodiment of a suspension basketball board in accordance with the present invention.

In a third embodiment as shown in FIG. 5, the suspension basketball board has only one hanging device 30B, and the hanging device 30B has three clamping panels 32B.

Figure 6:
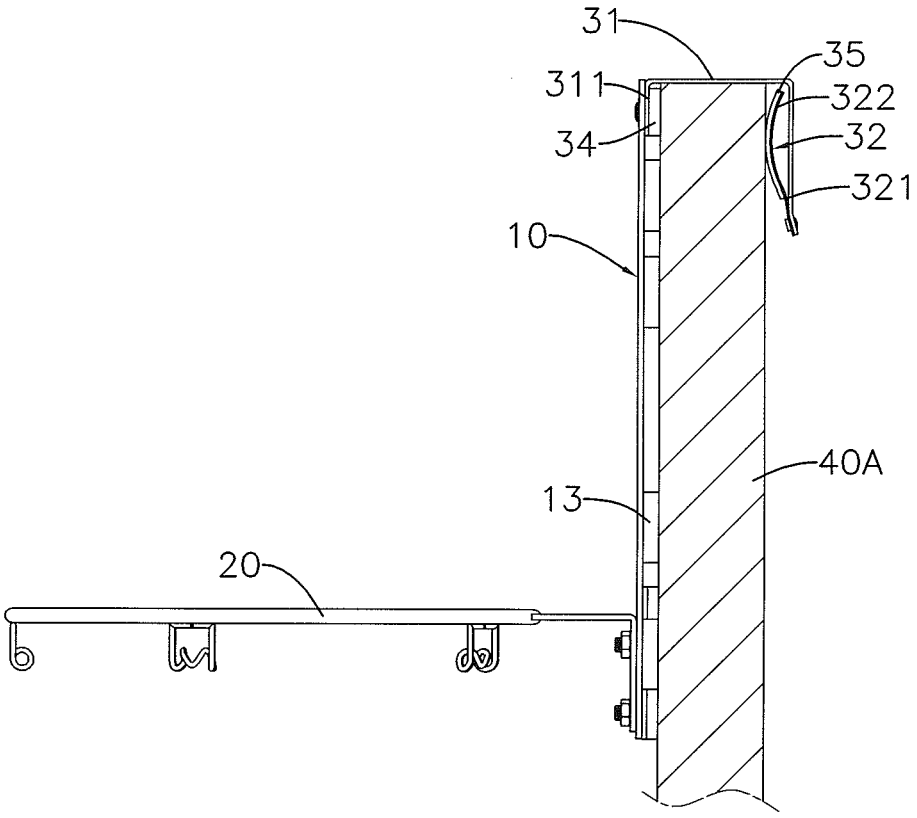
FIG. 6 is a side view of the suspension basketball board in FIG. 1, shown clamping another door of different thickness.

With reference to FIGS. 3 and 6, the suspension basketball board is hung on the door 40, 40A with the door 40, 40A clamped in the room 33 by the backboard 10 and the clamping panel 32 of the hanging device 30. A front surface of the door 40, 40A abuts the back surface of the hanging device 30 via the first hanging cushion 34 and the connecting panel 311 of the hanger 31 of each hanging device 30. A top side of the door 40, 40A abuts the top panel 3121 of the hanger 31 of each hanging device 30. A back surface of the door 40, 40A abuts the free end 322 of the clamping panel 32 of each hanging device 30 via the second hanging cushion 35 on the clamping panel 32. As the free end 322 abuts the door 40, 40A, a force is generated by the abutting and is exerted on the free end 322, such that the free end 322 is bent toward the hanger 31 with the fixed end 321 as a pivot.

As the clamping panel 32 is resilient relative to the hanger 31, the clamping panel 32 generates a counterforce applied on the door 40, 40A. Thus, the suspension basketball board clamps on the door 40, 40A without being inclined, and does not shake or fall easily. After the suspension basketball board is taken off from the door 40, 40A, the free end 322 of the clamping panel 32 is restored to the original position because the clamping panel 32 is resilient relative to the hanger 31.

Besides, the backboard cushion assembly 13, the first hanging cushion 34 on each hanging device 30 and the second hanging cushion 35 on the clamping panel 32 can prevent the door 40, 40A from colliding with and rubbing against the backboard 10 and the hanging device 30, thereby protecting the door 40, 40A from scratch and damage.

The clamping panel 32 is resilient relative to the hanger 31, such that the door can be stably clamped in the room 33 by the backboard 10 and the clamping panel 32. After use, the clamping panel 32 can be restored to the original position. Therefore, when the suspension basketball board is taken off from a door 40, the suspension basketball board can be hung on another door 40A of different thickness without being inclined. As a result, the suspension basketball board can be mounted horizontally and stably on doors 40, 40A of different thicknesses without affecting the player's shooting practice.

Figure 7:
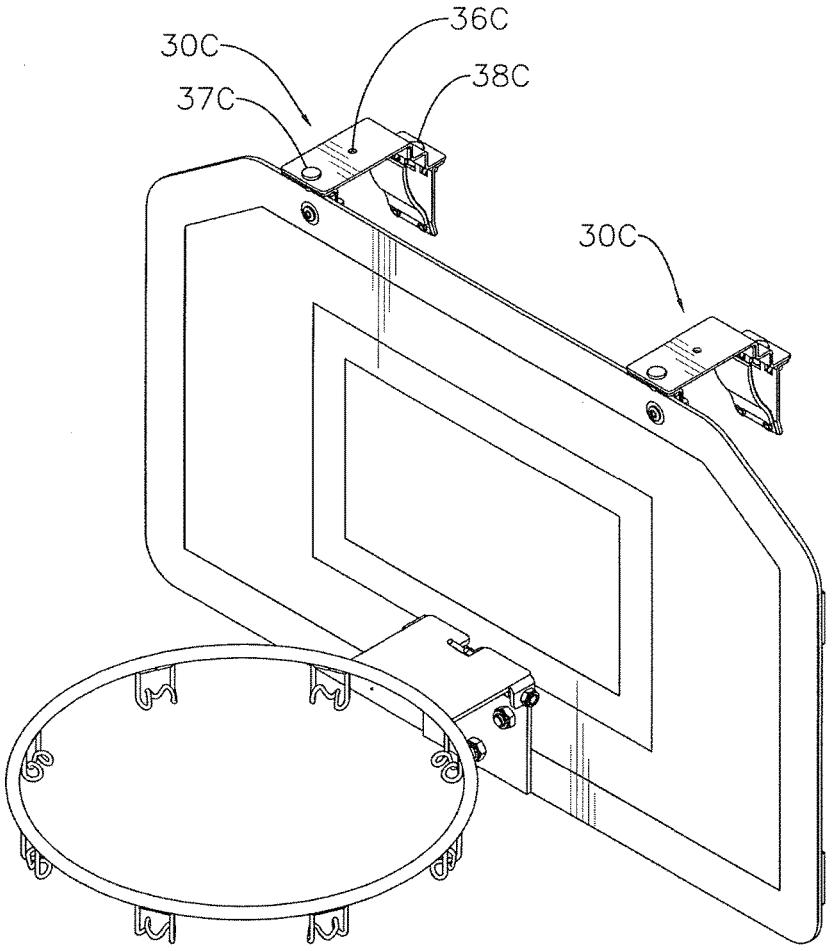
FIG. 7 is a perspective view of a fourth embodiment of a suspension basketball board in accordance with the present invention.
Figure 8:
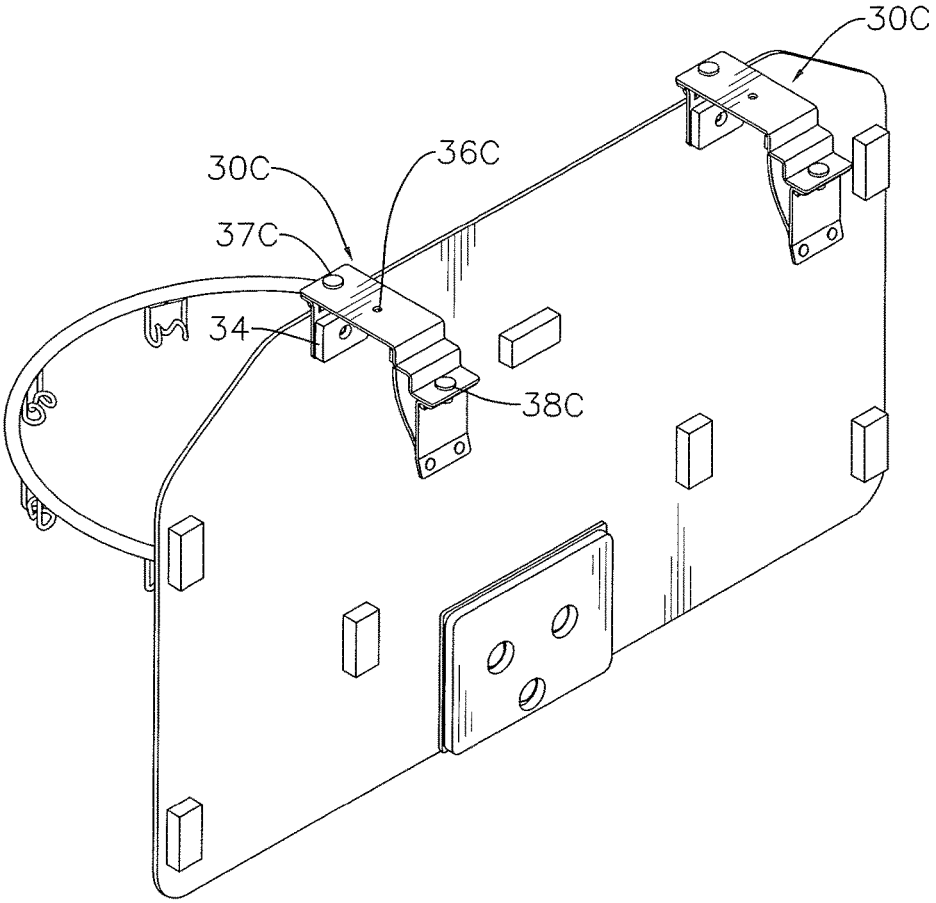
FIG. 8 is another perspective view of the suspension basketball board in FIG. 7.

As shown in FIGS. 7 and 8, the suspension basketball board of a fourth embodiment is similar to the suspension basketball board of the first embodiment. The differences between the suspension basketball board of the fourth embodiment and the suspension basketball board of the first embodiment are as follows.

In the fourth embodiment as shown is FIGS. 7 to 10, each one of the at least one hanging device 30C further comprises a mounting hole 36C, a first joint 37C and a second joint 38C.

The mounting hole 36C is formed through the top panel 3121C of the hook part 312C.

The first joint 37C is mounted between the connecting panel 311C and the front side of the top panel 3121C of the hook part 312C. The second joint 38C is mounted between the back side of the top panel 3121C of the hook part 312C and the back panel 31220 of the hook part 312C. Each of the first joint 37C and the second joint 38C comprises a first pivot 370C, 380C and a second pivot 375C, 385C. The first pivot 370C, 380C comprises a pivot body 371C, 381C and a rim 372C, 382C protruding transversely out from the pivot body 371C, 381C. The second pivot 375C, 385C is rod-like. The second pivot 375C, 385C is tightly mounted through the pivot body 371C, 381C, so that the relative position of the first pivot 370C, 380C and the second pivot 375C, 385C is fixed.

Further, the second pivot 375C, 385C has two terminal sections 377C, 387C and a middle section 376C, 386C connected between the terminal sections 377C, 387C. The middle section 376C, 386C has a diameter larger than diameters of the terminal sections 377C, 387C. The pivot body 371C, 381C has a connecting hole 373C, 383C having a diameter equal to or slightly less than the diameter of the middle section 376C, 386C. The middle section 376C, 386C of the second pivot 375C, 385C is disposed in the connecting hole 373C, 383C of the pivot body 371C, 381C, so as to tightly mount the second pivot 375C, 385C through the pivot body 371C, 381C.

Specifically, the connecting panel 311C comprises an upper sheet 51C, a lower sheet 52C, a connecting part 53C, a mounting space 54C, and a through hole 55C. The upper sheet 51C is connected with the front side of the top panel 3121C. The lower sheet 52C is connected with the upper sheet 51C and connected to the backboard 10. The connecting part 53C is connected between the lower sheet 52C and the upper sheet 51C, and is disposed at a bottom surface of the upper sheet 51C. The mounting space 54C of the connecting panel 311C is formed between the upper sheet 51C, the lower sheet 52C, and the connecting part 53C. The through hole 55C of the connecting panel 311C is formed through the upper sheet 51C and the lower sheet 52C. The through hole 55C of the connecting panel 311C is connected to the mounting space 54C of the connecting panel 311C.

The pivot body 371C of the first pivot 370C of the first joint 37C is mounted through the top panel 3121C of the hook part 312C at the front side, and is disposed in the through hole 55C of the connecting panel 311C and the mounting space 54C of the connecting panel 311C. The rim 372C of the first pivot 370C of the first joint 37C abuts the top panel 3121C of the hook part 312C at the front side. The second pivot 375C is mounted in the mounting space 54C and is mounted tightly through the pivot body 371C of the first pivot 370C of the first joint 37C.

Accordingly, the front side of the top panel 3121C of the hook part 312C is clamped between the rim 372C of the first pivot 370C of the first joint 37C and the upper sheet 51C. The top panel 3121C of the hook part 312C may pivot laterally about the connecting panel 311C by the first pivot 370C, and may pivot longitudinally about the connecting panel 311C by the second pivot 375C.

Besides, the first hanging cushion 34 is mounted on the lower sheet 52C of the connecting panel 311C.

Specifically, the back panel 3122C extends at a spaced interval from the back surface and comprises an upper plate 61C, a lower plate 62C, a connecting part 63C, a mounting space 64C, and a through hole 65C. The upper plate 61C is connected with the back side of the top panel 3121C. The lower plate 62C is connected with the upper plate 61C. The connecting part 63C is connected between the lower plate 62C and the upper plate 61C, and is disposed at a bottom surface of the upper plate 61C. The mounting space 64C of the back panel 3122C is formed between the upper plate 61C, the lower plate 62C, and the connecting part 63C. The through hole 65C of the back panel 3122C is formed through the upper plate 61C and the lower plate 62C. The through hole 65C of the back panel 3122C is connected to the mounting space 64C of the back panel 3122C.

The fixed end 321 of each of the at least one clamping panel 32 is connected to the lower plate 62C of the back panel 3122C and spaced from the top panel 3121C. The free end 322 of each of the at least one clamping panel 32 is spaced from and extends obliquely toward the backboard 10, and is spaced from and extends toward the top panel 3121C.

The pivot body 381C of the first pivot 380C of the second joint 38C is mounted through the top panel 31210 of the hook part 312C at the back side, and is disposed in the through hole 65C of the back panel 3122C and the mounting space 64C of the back panel 3122C. The rim 382C of the first pivot 380C of the second joint 38C abuts the top panel 3121C of the hook part 312C at the back side. The second pivot 385C is mounted in the mounting space 64C and is mounted tightly through the pivot body 3810 of the first pivot 380C of the second joint 38C.

Accordingly, the back side of the top panel 3121C of the hook part 312C is clamped between the rim 382C of the first pivot 380C of the second joint 38C and the upper plate 61C. The back panel 3122C of the hook part 312C may pivot longitudinally about the top panel 3121C of the hook part 312C by the second pivot 385C, and may pivot laterally about the top panel 3121C of the hook part 312C by the first pivot 380C.

In addition, each one of the at least one hanging device 30C further comprises a receiving space 71C disposed between the front side of the top panel 3121C of the hook part 312C and the back side of the top panel 3121C of the hook part 312C. The top panel 3121C of the hook part 312C is disposed between the receiving space 71C and the back panel 3122C of the hook part 312C. Each of the at least one clamping panel 32 is disposed in the receiving space 71C or the room 33.

Specifically, the top panel 3121C of the hook part 312C further comprises a bending portion 72C connected between the front side and the back side. The receiving space 71C is formed by bending the top panel 3121C. The bending portion 72C is disposed between the receiving space 71C and the back panel 3122C of the hook part 312C. Each one of the at least one hanging device 30C further has a top hanging cushion 39C mounted on the bending portion 72C of the top panel 3121C and disposed in the room 33.

Figure 11:
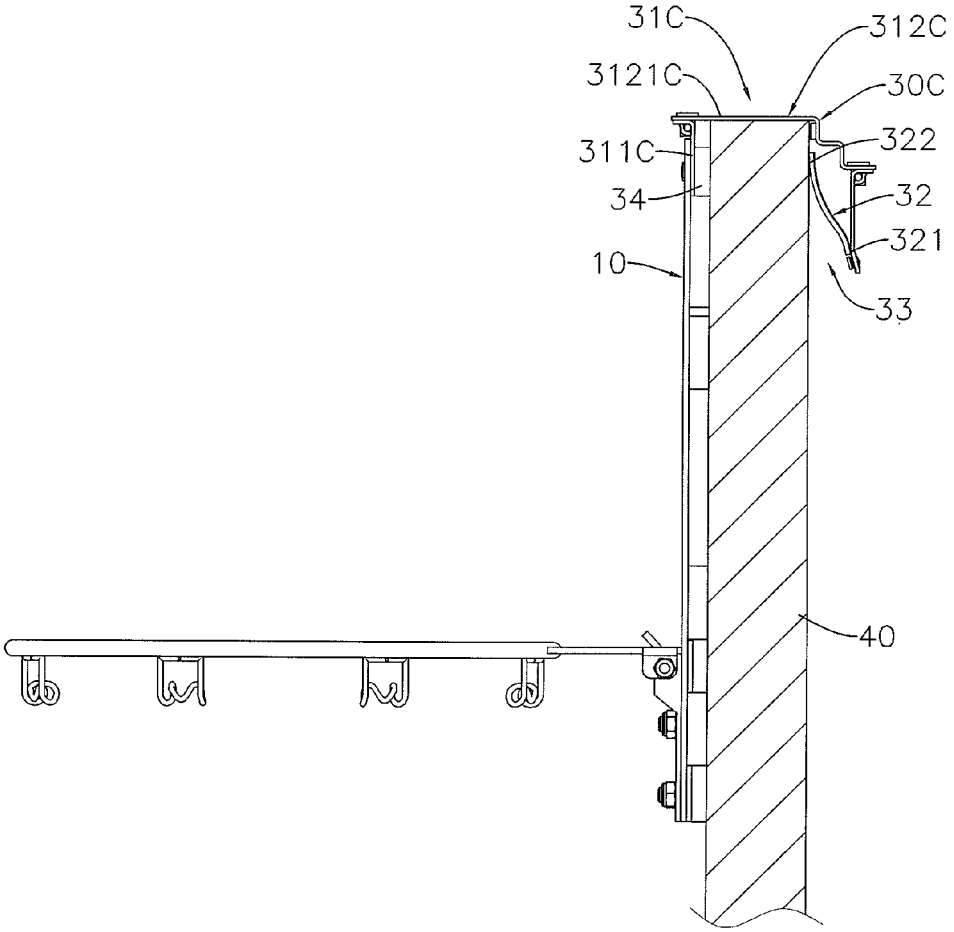
FIG. 11 is a side view of the suspension basketball board in FIG. 7, shown clamping a door.
Figure 12:
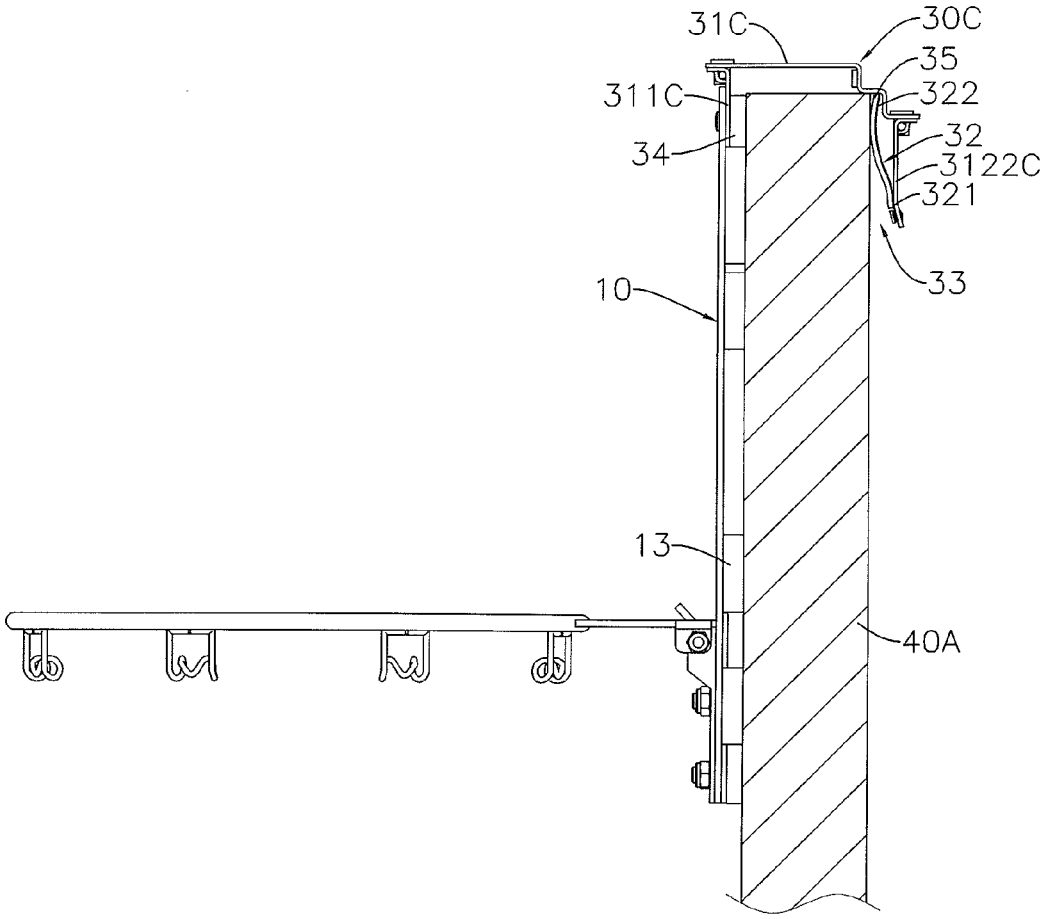
FIG. 12 is a side view of the suspension basketball board in FIG. 7, shown clamping another door of different thickness.

With reference to FIGS. 11 and 12, the suspension basketball board of the fourth embodiment is hung on the door 40, 40A with the door 40, 40A clamped in the room 33 by the backboard 10 and the clamping panel 32 of the hanging device 30C. A front surface of the door 40, 40A abuts the back surface of the hanging device 30C via the first hanging cushion 34 and the connecting panel 311C of the hanger 31C of each hanging device 30C. A top side of the door 40, 40A abuts the top panel 3121C of the hanger 31C of each hanging device 30C. A back surface of the door 40, 40A abuts the free end 322 of the clamping panel 32 of each hanging device 30C via the second hanging cushion 35 on the clamping panel 32. As the free end 322 abuts the door 40, 40A, a force is generated by the abutting and is exerted on the free end 322, such that the free end 322 is bent toward the hanger 31C with the fixed end 321 as a pivot.

As the clamping panel 32 is resilient relative to the hanger 31C, the clamping panel 32 generates a counterforce applied on the door 40, 40A. Thus, the suspension basketball board of the fourth embodiment clamps on the door 40, 40A without being inclined, and does not shake or fall easily. After the suspension basketball board of the fourth embodiment is taken off from the door 40, 40A, the free end 322 of the clamping panel 32 is restored to the original position because the clamping panel 32 is resilient relative to the hanger 31C.

Besides, the backboard cushion assembly 13, the first hanging cushion 34 on each hanging device 30C and the second hanging cushion 35 on the clamping panel 32 can prevent the door 40, 40A from colliding with and rubbing against the backboard 10 and the hanging device 30C, thereby protecting the door 40, 40A from scratch and damage.

The clamping panel 32 is resilient relative to the hanger 31C, such that the door can be stably clamped in the room 33 by the backboard 10 and the clamping panel 32. After use, the clamping panel 32 can be restored to the original position. Therefore, when the suspension basketball board of the fourth embodiment is taken off from a door 40, the suspension basketball board can be hung on another door 40A of different thickness without being inclined. As a result, the suspension basketball board of the fourth embodiment can be mounted horizontally and stably on doors 40, 40A of different thicknesses without affecting the player's shooting practice.

Figure 13:
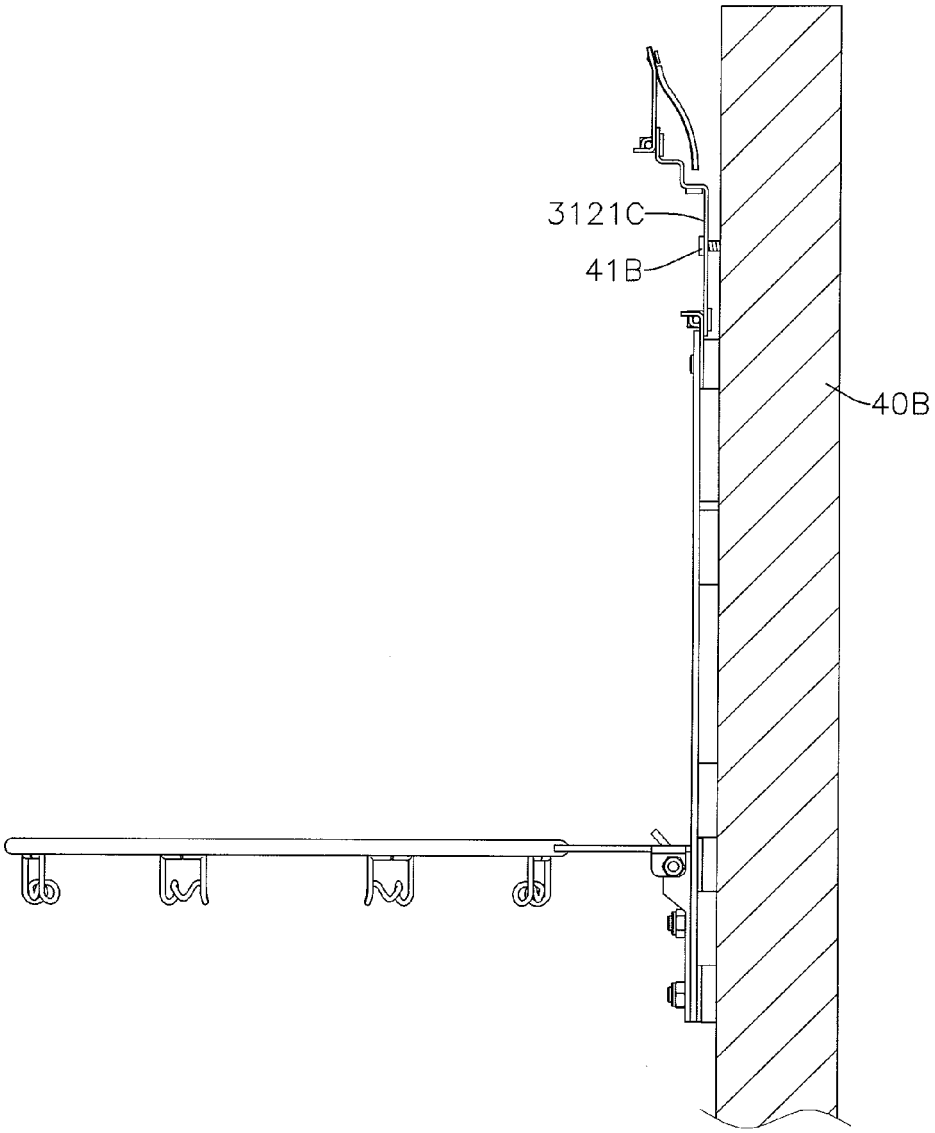
FIG. 13 is a side view of the suspension basketball board in FIG. 7, shown mounted on a wall.

With reference to FIG. 13, in addition to hanging on the doors with different thickness, the suspension basketball board of the fourth embodiment can be mounted on a wall 40B by a securing element, such as nails.

Specifically, to mount the suspension basketball board of the fourth embodiment on a wall 40B, each one of the at least one hanging device 30C is adjusted by the operations as follows.

Figure 9:
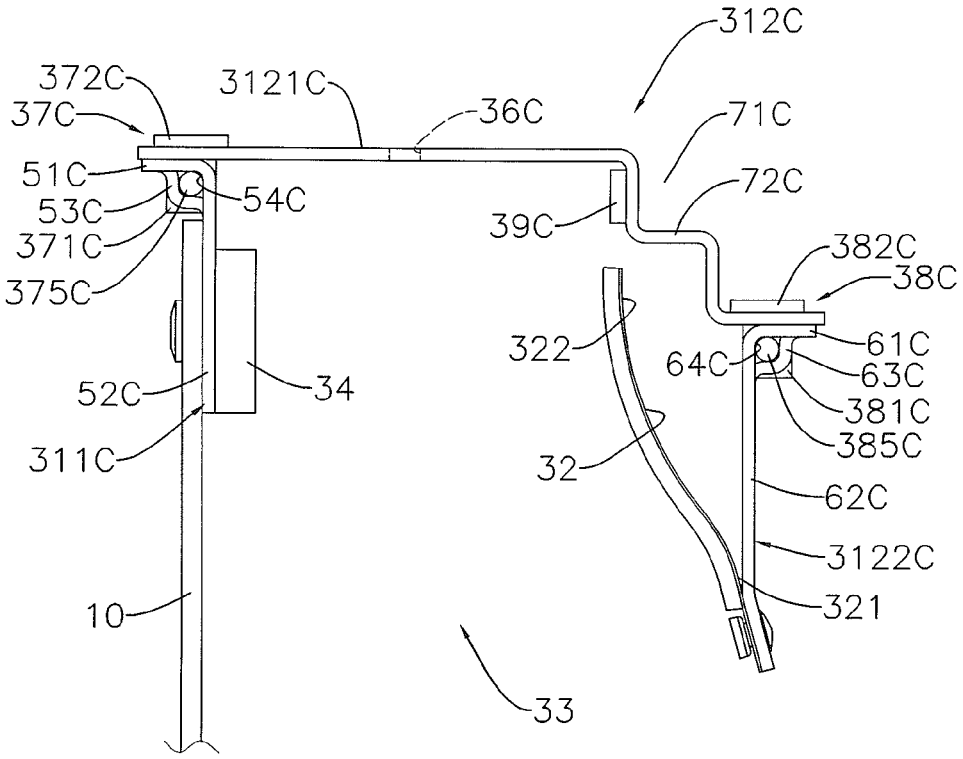
FIG. 9 is a partial enlarged side view of the suspension basketball board in FIG. 7.
Figure 10:
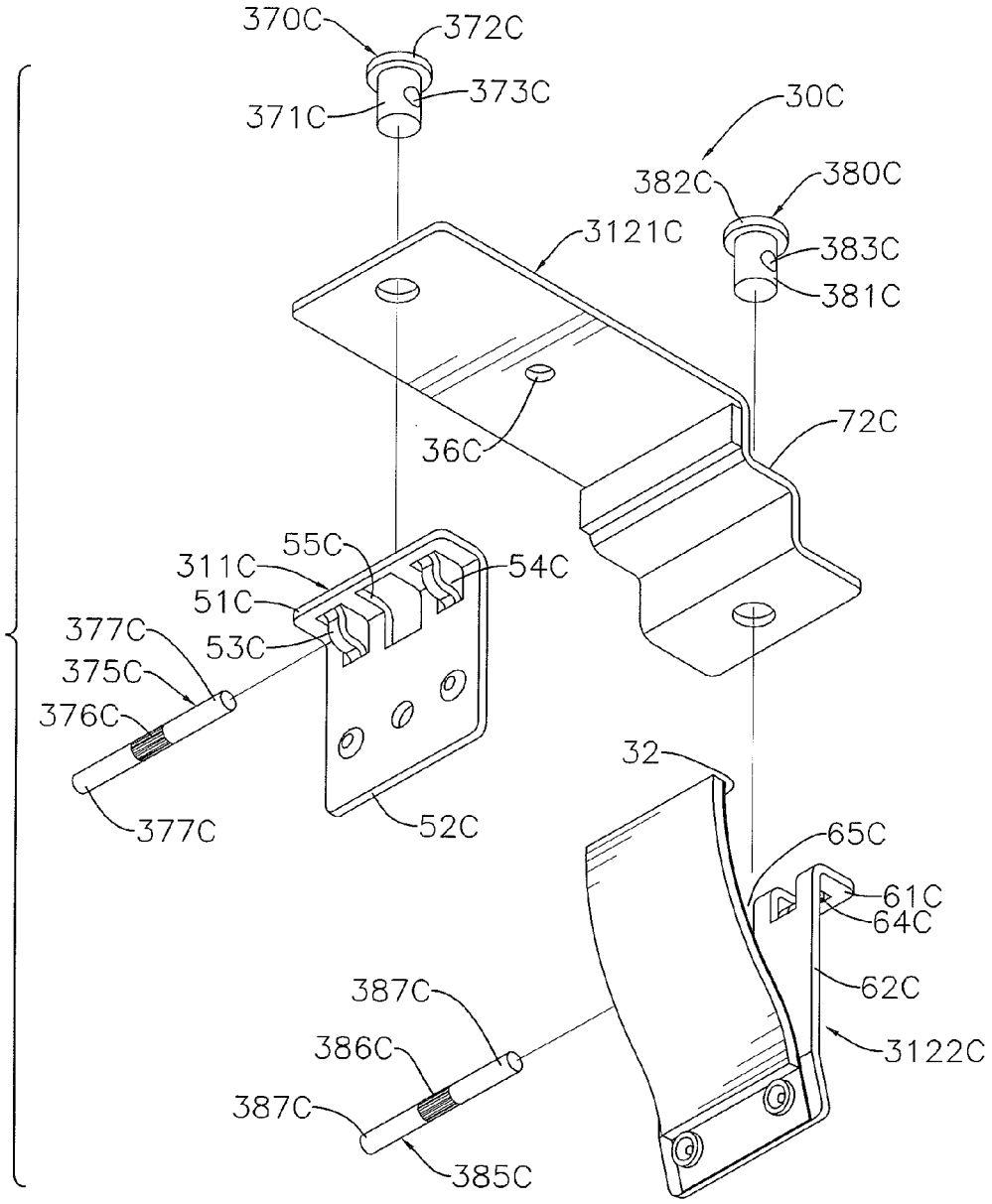
FIG. 10 is an exploded view of a hanging device of the suspension basketball board in FIG. 7.

In the beginning, with reference to FIGS. 9 and 11, each one of the at least one hanging device 30C is in an operational state for hanging on the doors. The clamping panel 32 is positioned in the room 33.

Figure 14:
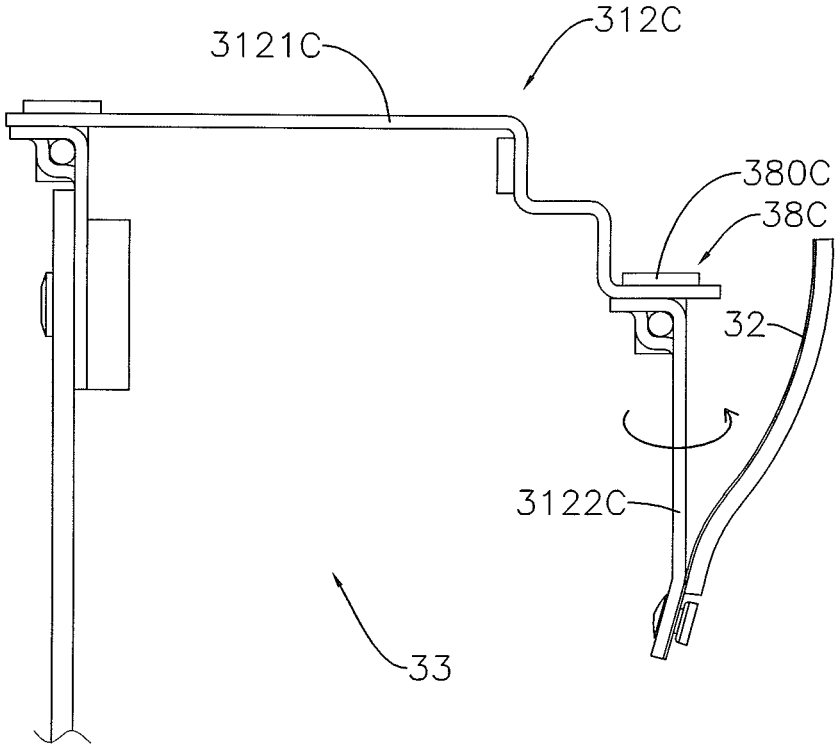
FIG. 14 is a first operational view of the suspension basketball board in FIG. 7, showing a back panel pivoting laterally about a top panel.

Subsequently, with reference to FIG. 14, the back panel 3122C of the hook part 312C pivots laterally about the top panel 3121C of the hook part 312C for 180° by the first pivot 380C of the second joint 38C. The clamping panel 32 is moved out from the room 33.

Figure 15:
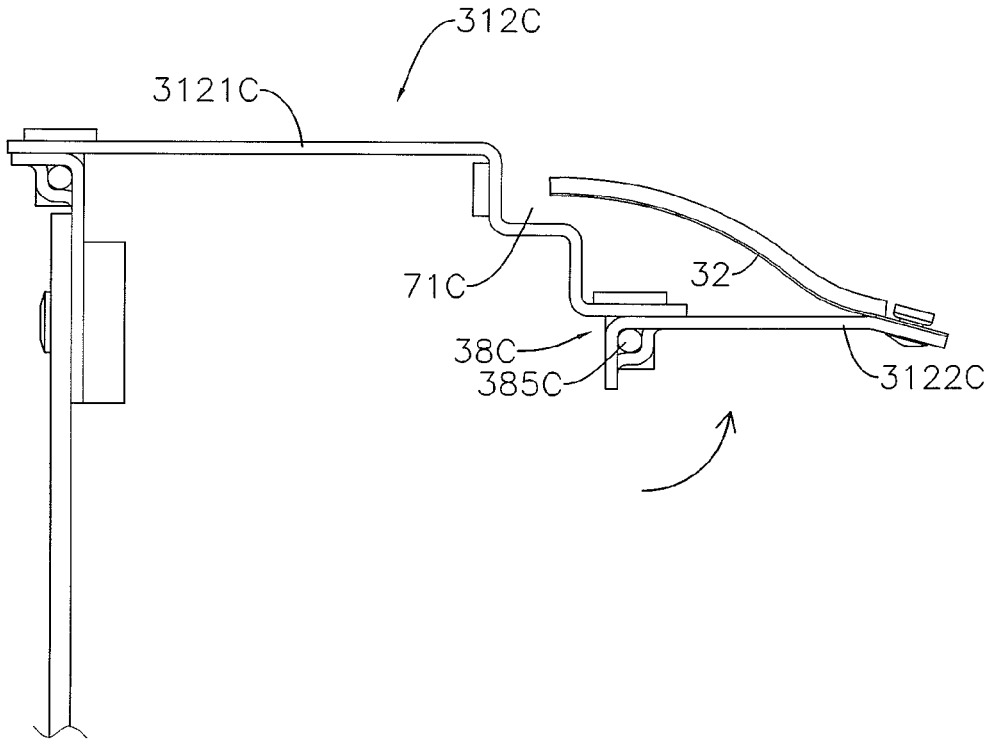
FIG. 15 is a second operational view of the suspension basketball board in FIG. 7, showing a back panel pivoting longitudinally about a top panel.

Subsequently, with reference to FIG. 15, the back panel 3122C of the hook part 312C pivots longitudinally about the top panel 3121C of the hook part 312C for 90° by the second pivot 385C of the second joint 38C. The clamping panel 32 is moved into the receiving space 71C.

Figure 16:
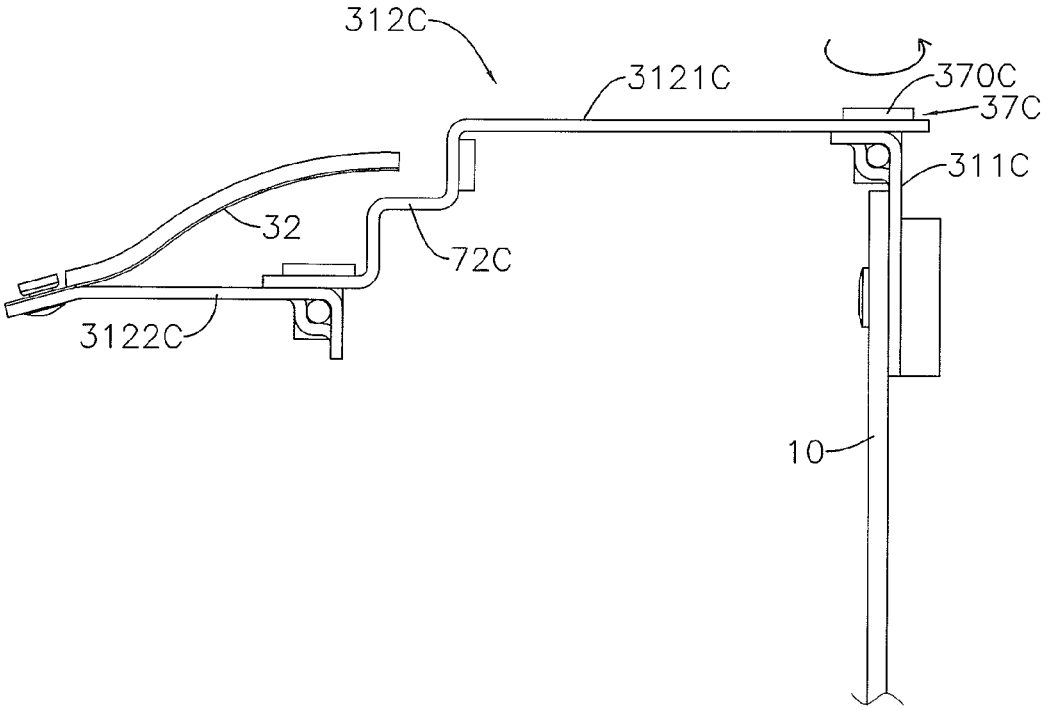
FIG. 16 is a third operational view of the suspension basketball board in FIG. 7, showing a top panel laterally pivoting about a connecting panel.

Subsequently, with reference to FIG. 16, the top panel 3121C of the hook part 312C pivots laterally about the connecting panel 311C for 180° by the first pivot 370C of the first joint 37C. The clamping panel 32, the back panel 3122C of the hook part 312C, and the back side and the bending portion 72C of back panel 3122C of the hook part 312C are moved from the rear side of the backboard 10 to the front side of the backboard 10.

Subsequently, with reference to FIG. 17, the top panel 3121C of the hook part 312C pivots longitudinally about the connecting panel 311C for 90° by the second pivot 375C of the first joint 37C. The clamping panel 32, the back panel 3122C of the hook part 312C, and the back side and the bending portion 72C of back panel 3122C of the hook part 312C are moved from the front side of the backboard 10 to a position above the backboard 10.

Figure 17:
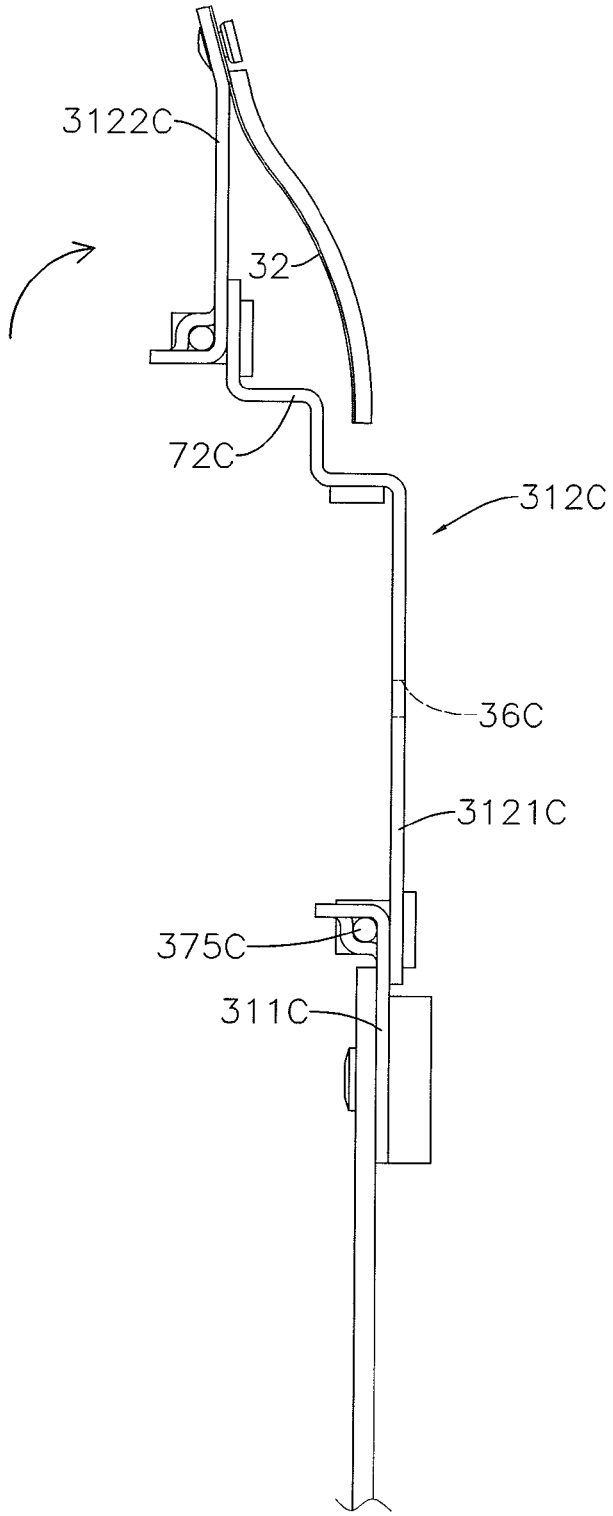
FIG. 17 is a second operational view of the suspension basketball board in FIG. 7, showing a top panel longitudinally pivoting about a connecting panel.
Figure 18:
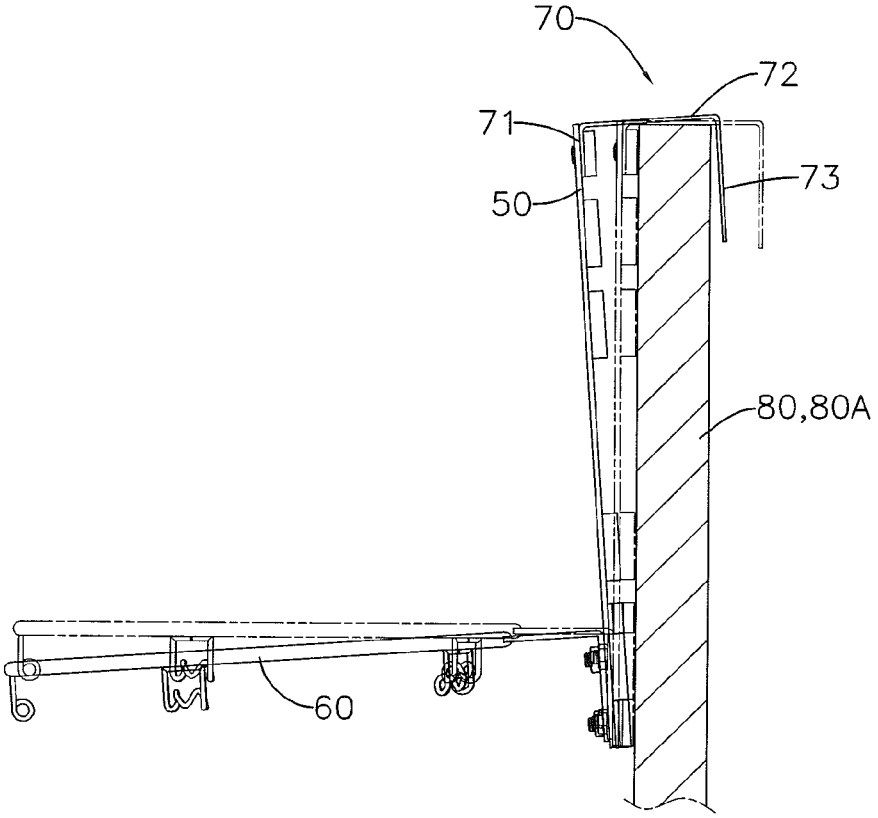
FIG. 18 PRIOR ART
FIG. 18 is a side view of a conventional suspension basketball board in accordance with the prior art.

Afterwards, with reference to FIGS. 13 and 17, the securing element 41B is mounted through the mounting hole 36C, abuts on the top panel 3121C of the hook part 312C, and is fixed on the wall 40B, so as to mount the suspension basketball board of the fourth embodiment on the wall 40B.

Accordingly, in addition to hanging on the doors with different thickness, the suspension basketball board of the fourth embodiment can be mounted on a wall 40B by the securing element 41B. Hence, the suspension basketball board of the fourth embodiment not only can be mounted horizontally and stably on doors 40, 40A of different thicknesses without affecting the player's shooting practice, but also can be mounted on doors 40, 40A or walls 40B for practice according to the player's needs, and thereby providing versatile usages for the player to choose.

Besides, the connecting panel 311C may be mounted on the backboard 10 by a rivet, so that the thickness of the first hanging cushion 34 may be reduced.

Further, the suspension basketball board of the fourth embodiment may be packaged under the state that the clamping panel 32, the back panel 3122C of the hook part 312C, and the back side and the bending portion 72C of the back panel 3122C of the hook part 312C are moved to the position above the backboard 10, so as to decrease the packaging thickness and save the packaging costs, the carriage charges, and storage spaces.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A suspension basketball board comprising:

a backboard having a front surface; and a back surface;

a basketball hoop mounted on the front surface of the backboard; and at least one hanging device mounted on the back surface of the backboard, and each one of the at least one hanging device having a hanger connected to the backboard and including:

a connecting panel connected to the backboard and having:

an upper sheet;

a lower sheet connected with the upper sheet and connected to the backboard;

a connecting part connected between the lower sheet and the upper sheet, and disposed at a bottom surface of the upper sheet;

a mounting space formed between the upper sheet, the lower sheet, and the connecting part; and a through hole formed through the upper sheet and the lower sheet, and connected to the mounting space of the connecting panel;

a top panel having a front portion connected to the upper sheet a back portion, a top surface, and a bottom surface; and a back panel connected to the back portion of the top panel, extending at a spaced interval from the back surface, and having:

an upper plate connected to the back portion at the bottom surface of the top panel;

a lower plate connected with the upper plate;

a connecting part connected between the lower plate and the upper plate, and disposed at a bottom surface of the upper plate;

a mounting space formed between the upper plate, the lower plate, and the connecting part of the back panel; and a through hole formed through the upper plate and the lower plate, and connected to the mounting space of the back panel;

at least one clamping panel connected to the hanger, being resilient relative to the hanger, and each one of the at least one clamping panel having:

a fixed end connected to the lower plate of the back panel and spaced from the top panel; and a free end spaced from and extending obliquely toward the backboard, and spaced from and extending toward the top panel;

a room defined between the backboard, the connecting panel, the top panel, and the back panel;

a mounting hole formed through the top panel;

a first joint mounted between the connecting panel and the front portion of the top panel; and a second joint mounted between the back portion of the top panel and the back panel;

wherein each of the first joint and the second joint includes:

a first pivot having a pivot body and a rim protruding transversely out from the pivot body; and a second pivot tightly mounted through a connecting hole in the pivot body;

the pivot body of the first pivot of the first joint is mounted through the top panel at the front portion, and is disposed in the through hole of the connecting panel and the mounting space of the connecting panel;

the rim of the first pivot of the first joint abuts the top panel at the top surface;

the second pivot of the first joint is mounted in the mounting space of the connecting panel and is mounted tightly through the pivot body of the first pivot of the first joint;

the pivot body of the first pivot of the second joint is mounted through the top panel at the back portion, and is disposed in the through hole of the back panel and the mounting space of the back panel;

the rim of the first pivot of the second joint abuts the top panel at the top surface;

the second pivot of the second joint is mounted in the mounting space and is mounted tightly through the pivot body of the first pivot of the second joint; and each of the at least one clamping panel is selectively disposed in the room.

2. The suspension basketball board as claimed in claim 1, wherein each one of the at least one hanging device further has a receiving space;

the top panel has a bending portion connected between the front portion and the back portion and disposed between the receiving space and the back panel; and each of the at least one clamping panel is alternatively disposed in the receiving space and the room.

3. The suspension basketball board as claimed in claim 1, wherein the suspension basketball board further comprises a backboard cushion assembly mounted on the back surface of the backboard.

4. The suspension basketball board as claimed in claim 2, wherein the suspension basketball board further comprises a backboard cushion assembly mounted on the back surface of the backboard.

5. The suspension basketball board as claimed in claim 1, wherein each one of the at least one hanging device has:

a first hanging cushion mounted on the hanger; and at least one second hanging cushion, and each of the at least one second hanging cushion mounted on the corresponding clamping panel;

wherein the at least one second hanging cushion and the first hanging cushion are disposed opposite each other on two sides of the room.

6. The suspension basketball board as claimed in claim 2, wherein each one of the at least one hanging device has:

a first hanging cushion mounted on the hanger; and at least one second hanging cushion, and each of the at least one second hanging cushion mounted on the corresponding clamping panel;

wherein the at least one second hanging cushion and the first hanging cushion are disposed opposite each other on two sides of the room.

7. The suspension basketball board as claimed in claim 3, wherein each one of the at least one hanging device has:

a first hanging cushion mounted on the hanger; and at least one second hanging cushion, and each of the at least one second hanging cushion mounted on the corresponding clamping panel;

wherein the at least one second hanging cushion and the first hanging cushion are disposed opposite each other on two sides of the room.

8. The suspension basketball board as claimed in claim 4, wherein each one of the at least one hanging device has:

a first hanging cushion mounted on the hanger; and at least one second hanging cushion, and each of the at least one second hanging cushion mounted on the corresponding clamping panel;

wherein the at least one second hanging cushion and the first hanging cushion are disposed opposite each other on two sides of the room.

9. The suspension basketball board as claimed in claim 2, wherein each one of the at least one hanging device has a top hanging cushion mounted on the bending portion of the top panel and disposed in the room.

10. The suspension basketball board as claimed in claim 4, wherein each one of the at least one hanging device has a top hanging cushion mounted on the bending portion of the top panel and disposed in the room.

11. The suspension basketball board as claimed in claim 6, wherein each one of the at least one hanging device has a top hanging cushion mounted on the bending portion of the top panel and disposed in the room.

12. The suspension basketball board as claimed in claim 8, wherein each one of the at least one hanging device has a top hanging cushion mounted on the bending portion of the top panel and disposed in the room.

* * * * *